US005787967A

United States Patent [19]

Vendeville et al.

[11] Patent Number: 5,787,967

[45] Date of Patent: Aug. 4, 1998

[54] PROCESS AND DEVICE FOR ADJUSTING THE CROWN OF THE ROLLS OF METAL STRIP CASTING PLANT

[75] Inventors: Luc Vendeville; Pierre Delassus, both of Bethune, France; Gérard Raisson, Nevers; Jean-Michel Damasse, Isbergues, all of France

[73] Assignees: Usinor Sacilor, Puteaux, France; Thyssen Stahl Aktiengesellschaft, Dulsburg, Germany

[21] Appl. No.: 622,783

[22] Filed: Mar. 27, 1996

[30] Foreign Application Priority Data

Apr. 7, 1995 [FR] France ..... 95 04139

[51] Int. Cl.[6] ..... B22D 11/06; B22D 11/16

[52] U.S. Cl. ..... 164/452; 164/154.1; 164/154.5; 164/154.7; 164/415; 164/428; 164/475; 164/480

[58] Field of Search ..... 164/452, 455, 164/475, 480, 154.1, 154.2, 154.5, 154.7, 415, 428

[56] References Cited

U.S. PATENT DOCUMENTS

| | | | |
|---|---|---|---|
| 4,565,240 | 1/1986 | Shibuya et al. | 164/452 X |
| 4,674,556 | 6/1987 | Sakaguchi et al. | 164/480 X |
| 5,191,927 | 3/1993 | Terado et al. | 164/480 X |
| 5,660,224 | 8/1997 | Barbe et al. | 164/415 |

FOREIGN PATENT DOCUMENTS

| | | | |
|---|---|---|---|
| 0407978 | 1/1991 | European Pat. Off. . | |
| 0409645 | 1/1991 | European Pat. Off. . | |
| 60-33857 | 2/1985 | Japan | 164/428 |
| 64-5646 | 1/1989 | Japan | 164/452 |
| 2-104449 | 4/1990 | Japan | 164/428 |
| 2-307652 | 12/1990 | Japan | 164/455 |
| 3-198951 | 8/1991 | Japan | 164/480 |
| 5-269552 | 10/1993 | Japan | 164/415 |
| WO94/02269 | 2/1994 | WIPO . | |
| WO95/03144 | 2/1995 | WIPO . | |

OTHER PUBLICATIONS

Abstract of Japanese Patent Publication 58–23549 Published Feb. 12, 1983.

*Primary Examiner*—J. Reed Batten, Jr.

*Attorney, Agent, or Firm*—Sixbey Friedman Leedom & Ferguson; Thomas W. Cole

[57] ABSTRACT

The solidification of the strip (9) is performed by introducing liquid metal between two horizontal rolls rotating in opposition directions (1, 1') which are cooled by an internal circulation of a coolant fluid. A casting space is defined between the rolls and their outer surfaces (3, 3') have a roughness. The casting space is blanketed by a cooling gas or a mixture of gases through a lid (10) covering the casting space. An adjustment of the crown or profile of the rolls (1, 1') is performed by modulating the quantity of cooling gas blown onto the rolls and/or the nature and composition of the gas at least in the vicinity of the surface of each roll (1, 1') upstream of its region of contact with the liquid metal (2).

11 Claims, 1 Drawing Sheet

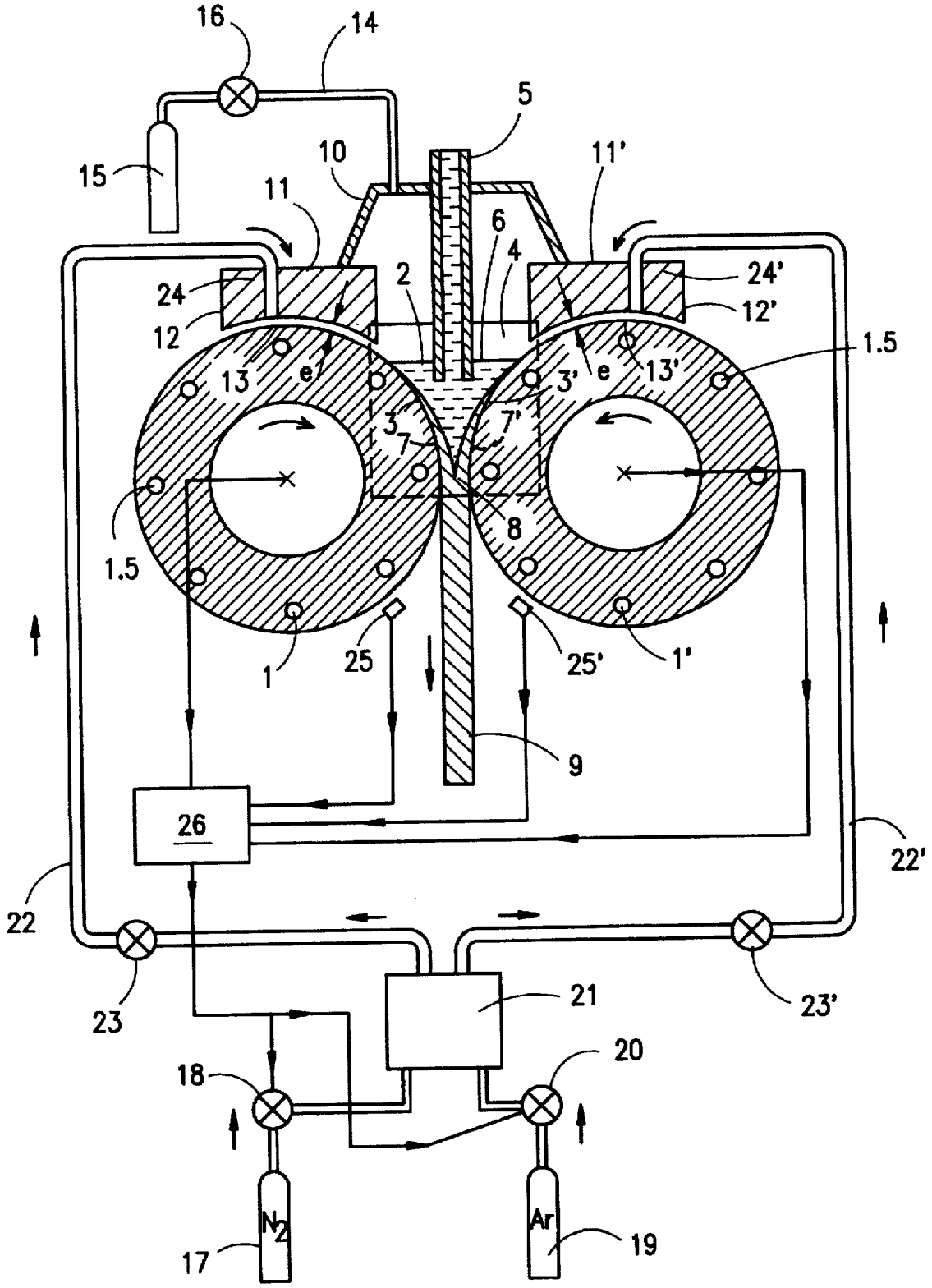
16
14
5
15
10
11'
11
6
4
2
24'
24
12'
12
1.5
13
e
3'
e
13'
3
7'
7
8
1.5
1
25
25'
1'
9
26
22'
22
23
21
23'
20
18
N2
Ar
17
19

PROCESS AND DEVICE FOR ADJUSTING THE CROWN OF THE ROLLS OF METAL STRIP CASTING PLANT

FIELD OF THE INVENTION

The invention relates to the casting of metallurgical products of small thickness which are obtained directly from liquid metal. More precisely, it relates to plants for casting thin strips, particularly of steel, by solidification of the liquid metal against two closely placed rolls with horizontal axes, driven in rotation in opposite directions and internally cooled.

PRIOR ART

In plants for casting thin steel strips between two rolls rotating in opposite directions the thickness profile of the strip depends closely on the shape adopted by the outer surfaces of the rolls in the casting space. Ideally, this profile of the strip ought to be rectangular or slightly convex to ensure good progress of the stage of cold rolling and a satisfactory thickness uniformity of the final product. To this end, the generatrices of each roll ought to remain rectilinear or slightly concave, especially at the nip, that is to say the region of the casting space in which the rolls are closest to each other. In practice this is not the case, because of the intense thermal stresses to which the rolls are subjected. Thus, a roll which, when cold, might have a perfectly rectilinear generatrix would have its outer surface becoming convex under the effect of the expansion. Since the thickness profile of the solidified strip is a faithful reproduction of the section of the casting space at the nip, a strip whose thickness increased appreciably and gradually from the centre towards the edges would be obtained. This would be detrimental to good progress of the cold rolling of the strip and to the quality of the products that would result therefrom.

This is why this expansion is usually anticipated by giving, when it is being made, the outer surface of each roll a slightly concave profile exhibiting a "crown" in the center of the roll, that is to say a difference in radius in relation to the edges. When cold, the optimum value of this crown varies according to the dimensions of the roll and may be, for example, approximately 0.5 mm. In this way a decrease in this crown takes place as the roll expands, and the profile of the roll in the casting space tends to approach a rectilinear profile. When casting is in progress, the value of this crown depends on the materials of which the rolls consist and on the system for cooling the cooled shell which constitutes the periphery of the roll, on the geometry of this shell and also on the way it is secured to the core of the roll, which may permit a greater or lesser expansion of the shell. However, it also depends on the operating conditions, which may vary from one casting to another, or even during the same casting, such as the height of the liquid metal present in the casting space and the intensity of the heat flow extracted from the metal by the means for cooling the roll.

It would be important to have available means giving the operator responsible for the functioning of the casting machine the possibility of modifying the crown of the rolls to some extent, so as to obtain continuously an optimum crown regardless of the casting conditions and of their variations. In addition, this would avoid having to employ separate pairs of rolls, each having a different initial crown, for each grade which it is desired to cast in optimum conditions.

One means of adjusting this crown could consist in modulating the heat flow extracted from the metal by modifying the flow rate of the coolant water which circulates inside the shell of each roll. In fact, the changes in the crown that could be obtained by this means alone would be minimal, of the order of a few hundredths of a millimeter. The reason for this is that the tolerable modification of this water flow rate is confined within small proportions in relation to the maximum permissible flow rate; otherwise, the penalty is excessively sensitive deterioration in the conditions in which the heat transfers take place between the shell and the water. It would then no longer be possible to control the conditions of metal solidification in a satisfactory manner.

SUMMARY OF THE INVENTION

The aim of the invention is to provide the operators with a means enabling them to adjust the crown of the rolls with a sufficient latitude, in the course of casting.

To this end, the subject of the invention is a process for casting a metal strip, particularly of steel, according to which the solidification of said strip is performed by introducing liquid metal between two rolls rotating in opposite directions, with horizontal axes, cooled by an internal circulation of a coolant fluid, defining a casting space between them, and whose outer surfaces have a roughness, and blanketing of said casting space is carried out by blowing in a given quantity of a gas or of a mixture of gases through a lid covering said casting space, in which an adjustment of the crown of said rolls is performed by modulating the quantity blown in and/or the nature of said gas or the composition of said mixture of gases, at least in the vicinity of the surface of each roll upstream of its region of contact with the liquid metal.

Another subject of the invention is a plant for casting a metal strip, particularly of steel, of the type comprising two rolls rotating in opposite directions, with horizontal axes, cooled by an internal circulation of a coolant fluid, defining between them a casting space intended to receive the liquid metal, and whose outer surfaces have a roughness, a device for blowing in a gas or a mixture of gases through a lid covering said casting space, and means for modulating the quantity blown in and/or the nature of said gas or the composition of said mixture of gases, at least in the vicinity of the surface of each roll upstream of its region of contact with the liquid metal, which comprises means for measuring or calculating the crown of the rolls in said casting space, or a quantity representing said crown of the rolls in said casting space.

As will have been understood, the invention consists in modulating the quantity and/or the composition of the gas present in the immediate vicinity of the surface of each roll, just before the latter comes into contact with the meniscus of liquid metal, or both these parameters, for the purpose of adjusting the crown of the rolls. In fact, when the casting rolls are not smooth but exhibit a roughness on their surface, the quantity and the composition of the gas present in the hollow parts of the surface of the roll have a direct influence on the coefficient of heat transfer between the metal and the roll. It is by this means that the heat flow extracted from the metal, on which the expansion of the roll and hence its crown depend, will be varied. This variation in the crown of the rolls can be performed in the course of casting, as a function of the specific conditions at the time.

The invention will be understood better on reading the description which follows and which is given with reference to the attached single figure. The latter shows diagrammatically, in cross-sectional view, a plant for casting metal strips between two rolls, enabling the invention to be implemented.

As has been stated, the expansion of the rolls is governed particularly by the flow of heat which they extract from the metal present in the casting space. Thus, experience has shown the inventors that the instantaneous heat flow $\Phi_i$ extracted by a roll from a given portion of metal with which it is in contact, expressed in $MW/m^2$, can be written:

$$\Phi_i = A\, t_i^{-0.35}$$

$t_i$ is the time elapsed since the last portion of metal came into contact with the roll at the meniscus, that is to say at the region where the roll and the free surface of the liquid metal present in the casting space meet each other. The fact that $\Phi_i$ decreases when $t_i$ increases reflects the deterioration in the quality of the heat transfers as the temperature of the metal drops. A is a heat transfer coefficient, expressed in $MW/m^2\, s^{0.35}$, the value of which depends on the conditions prevailing at the metal-roll interface.

From this expression for the instantaneous heat flow it is possible to calculate the mean heat flow $\Phi_m$ extracted from any portion of the solidifying and cooling skin which is in contact with the roll. This is done by virtue of an integration of $\Phi_i$ over the whole of this skin, whose various portions differ in the time since which they have been in contact with the roll. This time is included between 0 in the case of a portion of the skin situated at the meniscus, and $t_c$ in the case of a portion of the skin which leaves the roll at the nip. $t_c$ can be calculated as a function of the length of the arc of contact between the metal and the roll and of the speed of rotation of the rolls. $\Phi_m$ can therefore be written:

$$\Phi_m = \frac{1}{1c} \int_0^{1c} \Phi_i dt = \frac{A}{0.65}\, t_c^{0.35}$$

Moreover, $\Phi_m$ can be measured by means of the flow rate Q of coolant water passing through the roll, of the change in temperature $\Delta T$ of this water between its entry into and its exit from the roll and of the area of contact S between the metal and the roll, according to:

$$\Phi_m = Q\, \Delta T/S$$

When $t_c$ is known, A can be deduced from it by the calculation according to:

$$A = 0.65\, \Phi_m / t_c^{-0.35} = 0.65\, Q\, \Delta T/S\, t_c^{-0.35}$$

It was stated that the value of A depended on the conditions at the metal-roll interface. One of the most important characteristics of this interface is the roughness of the cooled surface of the roll shell. It has been found that a perfectly smooth roll surface which has a uniform thermal conductivity can cause the appearance of defects on the cast strip. The reason for this is that the effect of contraction of the skin of the strip during its cooling opposes the forces of adhesiveness of this same skin to the shell. This competition gives rise to stresses inside the skin, and these can result in the appearance of surface microcracks. To overcome these problems it is commonly accepted that it is preferable to employ rolls whose shell has some roughness, that is to say an alternation of smooth regions (or regions in relief) and of regions which are hollow in relation to the former, distributed uniformly or randomly. On the smooth regions and the regions in relief the metal skin adheres normally to the shell and can cool quickly. The width of the hollow regions, on the other hand, is calculated so that the metal which is solidifying should fill them only partially and so that, under the effect of the surface tension forces, it should not reach the bottom of these hollows. Vertically in line with at least the central parts of these hollows the metal is therefore not in direct contact with a cooled surface. A series of regions exhibiting a slight relief are therefore produced on the skin, opposite these hollows, and the solidification and cooling of these are less advanced than on the remainder of the skin. They constitute, as it were, a reserve of metal which exhibits some elasticity and can absorb, without cracking, the surface stresses linked with the contraction of the skin. In order to obtain a satisfactory surface quality of the cast strip, consideration has been given to arranging various kinds of engraving on the roll shells, such as criss-crossing V-section grooves. More recently it has been proposed to provide dimples in the shell, these being substantially circular or oval in shape, not touching each other, and from 0.1 to 1.2 mm in diameter and from 5 to 100 μm in depth (see document EP 0309247).

Before coming into contact with the liquid metal, the hollow regions are full of the gas which forms the boundary layer of the atmosphere directly above the rotating roll and which the latter entrains with it. When they come into contact with the meniscus and are then covered by the solidifying metal skin, the gas which filled them is trapped there. It is through the intermediacy of this gas that the cooled walls of the hollows which are not in contact with the skin will nevertheless take part in extracting the heat flow from the metal. The calculated value of the coefficient A takes account of the effect of the shell roughness on the overall heat transfer between the metal and the roll.

Exposing the surface of the liquid steel to the ambient air is very generally avoided; otherwise contamination of the metal due to the formation of oxide-containing inclusions would occur. Furthermore, this formation would result in consumption of the most easily oxidizable elements present in the steel. To isolate the surface from the air, the casting space is in most cases covered with a device forming a lid. Under this lid a gas which is completely inert toward the liquid metal (for example argon), or a gas in respect of which it is tolerable that it may dissolve partially in the liquid metal (for example nitrogen in the case where a stainless steel is being cast in which a low nitrogen content is not particularly sought after), or a mixture of such gases, is blown in toward the surface of the liquid steel. To avoid problems of wear, both of the rolls and of the lid, the latter generally does not rest on the rolls but is supported at a very small distance from their surface (a few mm). The disadvantage of such an arrangement is that the rolls entrain with them, especially in the hollows in their surface, a boundary layer of air whose oxidizing power is detrimental to the quality of the metal with which it comes into contact at the meniscus and below. This problem is overcome in some cases by blowing in argon and/or nitrogen in the immediate vicinity of the surface of the rolls, where the latter is underneath the lid, in addition to the blowing-in toward the surface of the liquid steel. This is performed at an adjustable flow rate which must be sufficient to result in dilution of the air boundary layer, so as to make the latter lose most of its oxidizing power. This is the solution which is adopted in particular in French Application FR 94 14571.

Because of the differences that exist between both their physical and chemical properties, not all the gases and gas mixtures that can be employed for the protection of the liquid metal have the same effect on the heat transfers between the metal and the roll. It is observed, for example, that these transfers take place more efficiently when nitrogen is employed as blanketing gas, rather than argon. A probable explanation of this phenomenon is that, since argon is practically insoluble in steel, all of it remains within the hollow regions. It therefore continuously forms therein a gas cushion between the bottom of the hollow regions and the metal skin, which contributes to preventing appreciable entry of the metal into the hollows. On the other hand, nitrogen which is trapped in the hollows is to a greater or lesser extent (depending on the grade being cast) absorbed by the metal when the latter has not yet completely solidified. In general, the quantity of gas present in the hollows is also a function of the flow rate of gas blown in, in particular in the immediate vicinity of the rolls. At an equal flow rate of gas blown in, the quantity of gas remaining present in each hollow region is therefore smaller in the case where nitrogen is employed than in the case where argon is employed. Nitrogen cannot thus impede the entry of metal into the hollows as much as argon does, and solidification conditions which are closer to those of a smooth roll are again encountered. In other words, when it is argon that essentially forms the gas boundary layer entrained by the rolls as far as the meniscus, the coefficient A of heat transfer between the roll and the solidifying metal skin is lower than in the case where the boundary layer consists of nitrogen. Also, in the case where a mixture of both these gases is employed, a decrease in A is observed when the percentage of argon in the mixture blown in in the vicinity of the surface of the rolls, upstream of the meniscus, is increased from the value $A_0$ which A assumes in the case of pure nitrogen:

$$A=A_0-K\ (\%\ \mathrm{Ar})$$

Experience shows that, in the case of various austenitic stainless steels and a given roughness of the rolls, $A_0$ can vary, for example, between 4.2 and 4.8, and K is of the order of 0.025 in the range of argon contents lower than or equal to 30%. Beyond this limit a marked decrease is observed in the effect of the argon content on the value of A. In the case of ferritic stainless steels the effect of the argon content on A is less marked and it becomes relatively weak in the case of carbon steels. These findings should be related to the differences in the solubility of nitrogen in these various grade types: the more soluble nitrogen is in the steel, the more its partial or complete replacement with an insoluble gas in the blanketing gas alters the conditions at the gas/metal interface. This means that the alternative form of the process according to the invention in which the crown of the rolls is adjusted by modifying the nature of the blanketing gas or the composition of the blanketing gas mixture finds its preferred application in the casting of stainless steels, in particular austenitic ones. The alternative form according to which the adjustment of the crown is obtained solely by modulating the flow rate of gas blown in applies more particularly to carbon steels. It is quite obvious that it is also possible to modify both parameters, the flow rate and the composition, at the same time.

The operator can determine the value of the heat flow passing through the roll by experimentation and deduce the value of A therefrom by calculation, the rate of casting being known. By virtue of previous experiments or of modelling techniques, he deduces from this value of A, for each type of roughness of the rolls and for each grade category, the crown of the roll that would be expected if the roll had a perfectly rectilinear generatrix when cold. Finally, the operator deduces therefrom the shape correction which it is preferable to apply to the roll when it is manufactured, in order that, in at least most of the actual experimental conditions, it should be possible to obtain a roll whose generatrices would adopt the desired rectilinear or slightly concave shape when hot, merely by modifying the composition and/or the flow rate of the blanketing gas, in accordance with the invention.

To modify the nature of the blanketing gas, the operator has the possibility of employing either pure nitrogen or pure argon in order to be able to have the choice between two roll crowns in the case of a given gas flow rate and given casting conditions. Obviously, however, it is preferable to have the possibility of employing a mixture of these two gases (or of any other suitable gases) in respective proportions that can be varied at will according to the needs of the adjustment of the crown, so as to perform this adjustment as precisely as possible.

DESCRIPTION OF THE PREFERRED EMBODIMENTS

A nonlimiting example of a device enabling the invention to be implemented is shown diagrammatically in the single figure. In a conventional manner, the casting plant includes two rolls 1, 1' placed close to each other, energetically cooled internally by a flow of water through passages 1.5 and driven in rotation in opposite directions about their horizontal axes by means which are not shown, and means for delivering liquid steel 2 into the casting space defined by the outer surfaces 3, 3' of the rolls 1, 1' and closed off at the sides by two refractory plates, one of which, 4, can be seen in the figure. These means of delivery include a small nozzle 5 connected to a distributor, not shown, and whose lower end is immersed below the surface 6 of the liquid steel 2 enclosed by the casting space. The liquid steel 2 begins to solidify on the outer surfaces 3, 3' of the rolls 1, 1' forming thereon skins 7, 7', the joining of which at the nip 8, that is to say in the region where the gap between the rolls 1, 1' is smallest, gives rise to a solidified strip 9 a few mm in thickness, which is continuously extracted from the casting plant. The blanketing of the casting space is ensured by a lid 10 through which the small nozzle 5 passes and which rests on two blocks 11, 11' extending over the whole width of the rolls 1, 1'. The lower faces 12, 12' of these blocks 11, 11' are shaped so as to match the curvatures of the outer surfaces 3, 3' of the rolls 1, 1' and to define with them, when the blanketing device is in operation, a space 13, 13' of width "e" equal to a few mm. The blowing-in of a blanketing gas is provided first of all by a conduit 14 passing through the lid 10 and emerging above the surface 6 of the liquid steel 2 present in the casting space. This conduit 14 is connected to a storage vessel 15 for gas containing, for example, nitrogen or argon, and whose flow rate and blowing-in pressure are controlled by a valve 16.

Furthermore, for making use of the process according to the invention, blowing-in of gases at controlled flow rates and composition is performed through blocks 11, 11'. A nitrogen storage vessel 17 fitted with a valve 18 and an argon storage vessel 19 fitted with a valve 20 are connected to a mixing chamber 21. It is from this mixing chamber 21 that the gas or, more generally, the mixture of gases is taken and will, according to the invention, form the boundary layer entrained by the outer surfaces of the rolls 1, 1' as far as their regions of contact with the surface 6 of the liquid metal present in the casting space, which form the meniscus. To this end, a conduit 22 fitted with a valve 23 leaves the mixing chamber 21 and delivers a proportion of the gas mixture which is present therein into the block 11, where a slot 24 (or a plurality of closely spaced holes, or a porous component) distributes it as uniformly as possible into the space 13 defined by the inner face 12 of the block 11 and the outer face 3 of the roll 1. The valve 23 allows the flow rate and the pressure of the gas mixture to be adjusted. A symmetrical device including a conduit 22' fitted with a valve 23' also delivers the gas mixture into the block 11' and then, via a slot 24', into the space 13' separating the block 11' and the roll 1'.

In an alternative form, gas feed devices which are completely independent from each other can also be provided for each block 11, 11', so as to make it possible to adjust separately the compositions of the gas mixtures present in the spaces 13, 13' and hence the crown of each of the rolls 1, 1'. A possible difference in the cooling conditions of each of the rolls 1, 1' can thus be taken into account. Furthermore, it is also possible to choose to sample the gas blown in under the lid 10 into the mixing chamber 21, too, and to give it the same composition as the gas mixture which is to form the boundary layer at the surface of the rolls 1, 1'.

Another alternative form of the device according to the invention consists, as in French Application 94 14571, already referred to, in providing, inside each block 11, 11', a second slot (or another functionally equivalent member) similar to the slot 24, 24' and emerging upstream of the latter in the space 13, 13' in relation to the forward travel of the surface 3, 3' of the roll 1, 1'. This second slot directs the gas which has emerged from it toward the exterior of the space 13, 13', while the slot 24, 24' directs the gas leaving it toward the casting space and hence in the direction of forward travel of the surface 3, 3' of the roll 1, 1'. Better leakproofing of the space 13, 13' with regard to the external environment is thus obtained, and hence a finer control of the composition of the boundary layer. This makes it easier to adjust the crown of the rolls 1, 1'.

Similarly, the gas or the gas mixture delivered into the spaces 13, 13' separating the blocks 11, 11' and the rolls 1, 1' may be not only in the gaseous state, as has been implicitly assumed hitherto, but also in the liquid state. It is also possible to envisage heating it, adjusting its temperature.

It must be understood that the blanketing device which has just been described forms only one example of implementation of the invention and that any other device making it possible to control the composition of the gas present above the casting space, and especially of the gas boundary layer entrained by the outer surface of each roll as far as the meniscus, could also be suitable.

In order to control the crown of the rolls in the course of casting according to the process of the invention the operator (or the automatic devices) responsible for the operation of the casting plant must have access to a number of data, to ensure that the composition and the flow rate of the blanketing gas which are adopted do indeed produce the desired crown, and hence a suitable quality in the case of the product. To this end, one possibility consists in continuously collecting the data (coolant water flow rate, change in its temperature between the roll entry and exit) which make it possible to calculate the heat flow passing through the roll, to calculate it at short intervals and to deduce from it the crown such as can be predicted by mathematical models and/or previous calibrations. Another procedural method is to measure the crown of the rolls continuously in a region as close as possible to the casting space, to deduce from it the value of the crown in its contact regions and to adjust the composition of the blanketing gas as a result. This measurement of the crown can be carried out, for example, with the aid of a set of contactless shape-measuring sensors such as capacitive sensors or laser sensors, distributed along at least one generatrix of one of the rolls or, better, of two sets of such sensors, each fitted on a different roll. The single figure shows diagrammatically such sensors 25, 25', which are connected to a calculating unit 26. The latter also receives the abovementioned data which enable it to calculate the heat flows passing through the rolls 1, 1' and, as a result, determines the respective openings of the valves 18, 20, in order to control the flow rate and the composition of the gas mixture at the values which provide a crown deemed to be the best at the rolls 1, 1'. The measurement of the thermal profile of the strip along its width, carried out at the exit from the rolls, can also provide at least qualitative indications as to the crown imparted to it by the rolls, because the temperature difference between the center of the strip and regions closer to the edges is an indication of the variations in the thickness of the strip. Finally, a device for directly measuring the thickness of the strip and its variations along its width, such as X-ray gauges, can be installed downstream of the rolls, by virtue of which the effects of the crown of the rolls on the strip can be observed directly and, if necessary, the crown can be corrected using the process according to the invention.

It is also possible to envisage coupling the process according to the invention with a control of the crown using the flow rate of water for cooling the rolls. It was stated earlier that it is difficult to obtain high-amplitude variations of the crown merely by this latter method. However, it can be employed for finely complementing a coarser control of the crown carried out beforehand by affecting the flow rate and/or the composition of the blanketing gas.

The invention is, of course, not limited to the casting of steel strips and can be applied to the casting of other metallic materials.

What is claimed is:

1. A process for casting a metal strip wherein the solidification of said strip is achieved by introducing liquid metal between two rolls rotating in opposite directions, with horizontal axes, that are cooled by an internal circulation of a coolant fluid and whose outer surfaces have a crown shape that is temperature dependent and a roughness capable of retaining a film of gas at a liquid metal interface, said rolls defining a casting space between them, comprising the steps of blanketing said casting space with a gas by blowing in a given quantity of a gas or of a mixture of gases through a lid covering said casting space, and adjusting the shape of the crown of said rolls by controlling the temperature at the interface between the two rolls and the liquid metal by modulating the quantity of gas blown in and/or the composition of said mixture of gases at least in the vicinity of the surface of each roll upstream of its region of contact with the liquid metal.

2. The process as claimed in claim 1, wherein said control of the crown is supplemented by modifying the flow rate of said coolant fluid.

3. A plant for casting a metal strip, comprising two rolls rotating in opposite directions with horizontal axes, cooled by an internal circulation of a coolant fluid, defining between them a casting space intended to receive liquid metal, and whose outer surfaces have a crown shape that is temperature dependent, and a roughness capable of retaining a film of gas, a device for blowing in a gas or a mixture of gases through a lid covering said casting space, and means for modulating the quantity blown in and/or the composition of said mixture of gases at least in the vicinity of the surface of each roll upstream of its region of contact with the liquid metal in order to adjust said crown shape by controlling the temperature at the interface between the rolls and the liquid metal, which includes means for measuring or calculating the shape of a crown on the outer surface of the rolls in said casting space, or a quantity representing said crown of the rolls in said casting space.

4. The plant as claimed in claim 3, wherein said lid comprises two blocks the lower face of each of which defines a space with the outer surface of one of said rolls, said blocks extending over the whole width of said rolls and means for blowing in said gas or said mixture of gases, modulated in quantity and/or in kind or composition within said space.

5. The plant as claimed in claim 3, wherein said mixture of gases is a mixture of nitrogen and argon.

6. The plant as claimed in claim 3, wherein the means for measuring the crown of the rolls comprise at least one set of shape-measuring sensors arranged along a generatrix of one of the rolls.

7. The plant as claimed in claim 3, wherein said means for calculating the crown of the rolls comprise means for measuring the heat flow passing through the rolls.

8. The plant as claimed in claim 3, wherein said quantity representing the crown of the rolls is the thickness profile of the strip along its width.

9. The plant as claimed in claim 8, which comprises means for measuring the variations in temperature of said strip along its width.

10. The plant as claimed in claim 9, which comprises means for direct measurement of the thickness profile of said strip along its width.

11. A plant for casting a metal strip comprising:

two rolls rotating in opposite directions with horizontal axes and cooled by an internal circulation of a coolant fluid, said rolls defining between them a casting space intended to receive liquid metal, the outer surfaces of said rolls having a crown shape that is temperature dependent, and a roughness capable of retaining a film of gas;

a lid covering said casting space;

a device for blowing in a gas or a mixture of gases through said lid, and means for modulating the quantity of gas blown through said lid by said device and/or the composition of said mixture of gases at least in the vicinity of the surface of each roll upstream of its region of contact with the liquid metal in order to adjust said crown shape by controlling the temperature of the interface between the rolls and liquid metal, said means for modulating including a means for measuring or calculating the shape of a crown on the outer surface of the rolls in said casting space, and means for controlling said modulating means such that the measured or calculated crown shape conforms to a predetermined crown shape.

* * * * *